United States Patent [19]

Develay et al.

[11] 4,000,007

[45] Dec. 28, 1976

[54] METHOD OF MAKING DRAWN AND HEMMED ALUMINUM SHEET METAL AND ARTICLES MADE THEREBY

[75] Inventors: Roger Develay, Seyssins; Richard Deschamps, Seyssinet-Pariset; Jacques Peyraud, L'Hay-les-Roses, all of France

[73] Assignee: Cegedur Societe de Transformation de l'Aluminium Pechiney, Paris, France

[22] Filed: May 7, 1975

[21] Appl. No.: 575,134

Related U.S. Application Data

[63] Continuation-in-part of Ser. No. 365,825, June 1, 1973, abandoned.

[30] Foreign Application Priority Data

Feb. 13, 1973 France ..... 73.05010

[52] U.S. Cl. ..... 148/2; 75/141; 75/142; 148/12.7 A; 148/32.5

[51] Int. Cl.[2] ..... C22F 1/04; C22C 21/16

[58] Field of Search ..... 148/32, 32.5, 11.5 A, 148/12.7 A, 2, 3; 75/142, 141

[56] References Cited

UNITED STATES PATENTS

| | | | |
|---|---|---|---|
| 1,472,740 | 10/1923 | Archer et al. | 75/142 |
| 3,032,448 | 5/1962 | Seibel et al. | 148/12.7 A |

*Primary Examiner*—R. Dean

*Attorney, Agent, or Firm*—Browdy and Neimark

[57] ABSTRACT

Drawn and hemmed metal parts, such as vehicle body panels, are made from an aluminum based alloy containing 1.5–2.5% copper, 0.5–1.0% magnesium and 0.4–0.8% silicon and in addition may contain up to 0.2% chromium, 0.4% manganese, 0.2% titanium, 0.2% zirconium and 0.5% iron.

12 Claims, No Drawings

METHOD OF MAKING DRAWN AND HEMMED ALUMINUM SHEET METAL AND ARTICLES MADE THEREBY

CROSS-REFERENCE TO RELATED APPLICATION

The present application is a continuation-in-part of U.S. Ser. No. 365,825, filed June 1, 1973, abandoned, here incorporated by reference.

FIELD OF THE INVENTION

The present invention relates to an aluminum based alloy containing copper, magnesium and silicon, which is especially suitable for the manufacture of drawn, beaten, stamped or pressed parts which are easy to hem and to braze or weld and more particularly for the manufacture of such drawn and hemmed sheet metal and of car body panels made by cold deformation from such sheet metal.

BACKGROUND OF THE INVENTION

Several types of Al-Cu-Mg alloys including other metals and elements, such as silicon, have already been proposed for the manufacture of drawn materials.

For example, the alloy $AU_2G$ additionally contains very small quantities of other constituents, namely 2 to 2.80% Cu, 0.2 to 0.6% Mg and less than 0.4% Si. This alloy, which is used to a certain extent in the motor industry, sometimes has insufficient drawing capacity when the shape of the desired part is complicated. Furthermore, its mechanical characteristics under traction, which generally are good for the matured, hardened state, are easily altered when the shaped part is subjected to heating, for example, during the baking of paint in the case of car body panels. A loss of yield strength and of tensile strength of the order of 4 $Kg/mm^2$ is observed after treatment for 15 minutes to 3 hours at 150° to 180° C. Finally, this alloy does not allow good welding of the shaped parts, since it is very susceptible to shrinkage cracking during welding with an oxyacetylene blow-pipe or under neutral gas.

Applicants have disclosed, in French Patent Specification No. 7,239,081, filed Oct. 29, 1971, Al-Cu-Mg alloys which have a greater proportion of Mg, this is to say 1.80 to 2.60%. These alloys have a range of interesting properties but also like the $AU_2G$ alloy mentioned above, have disadvantages in relation to weldability and shaping in difficult cases.

Altenpohl, in his work "Aluminum und Aluminumlegierungen" has referred (pages 710 to 713), as being a product suitable for drawn pieces, to an Al-Cu-Mg alloy, which conforms with the German Standard DIN 1725 Bl 1 and contains 2 to 3% Cu and up to 0.5% Mg and possibly also includes silicon (less than 0.8%). As will be shown in the present description, alloys of this type or those in which the quantity of Mg can be increased to 1.5% (according to Altenpohl), cannot be regarded as suitable for drawn sheet-metal bodywork panels, since the resultant parts cannot be both hemmed and welded.

SUMMARY OF THE INVENTION

It has now been found, following work by applicants, that by carefully choosing the proportions of the constituents in alloys of the Al-Cu-Mg-Si type and by studying in detail the total characteristics to be obtained for a material which is eminently suited for drawn vehicle body panels, it was possible to provide an alloy giving, in their optimum condition, a combination of the properties which have not been obtainable previously, in particular, a good ability for casting in the form of large slabs, allowing high productivity in rolling on continuous rolling mills; good hot deformation allowing rolling to large size with relatively little stress, as well as excellent cold deformation; good capacity for drawing and hemming; the mechanical characteristics before drawing being comparable to those of steel and not decreasing as a result of a series of thermal treatment cycles corresponding to the baking of paint; good operative weldability, especially in the case of biaxial tension, as well as good spot-weldability; and finally, good resistance to corrosion.

According to the invention, an aluminum alloy is provided which contains:

1.5 to 2.5% of copper (Cu);
0.5 to 1% of magnesium (Mg);
0.4 to 0.8% of silicon (Si);

the amounts of Mg and Si being such that the sum, Mg + Si, is less than or equal to 1.6%.

As will be shown in the examples below, the amounts of Cu, Mg and Si and the relative proportions of these elements are of great importance. When the quantity of Cu is below 1.5%, with the stated amounts of Mg and Si, the alloy has inadequate mechanical characteristics. When, on the contrary, more than 2.5% of Cu is present, hemming of parts made from the alloy is no longer possible. However, when the Si content is less than 0.4% (for the stated proportions of Cu and Mg), the alloy does not keep its good tensile strength properties during thermal treatment equivalent to the baking of paint and also its weldability is reduced; when, on the contrary, the Si content is higher than 0.8%, the alloy is no longer suitable for hemming. Also, when the amount of Mg is less then 0.5%, the mechanical characteristics after solution heat treatment and ageing at ambient temperature are insufficient. If on the contrary the Mg content is higher than 1%, the alloy is no longer suitable for hemming and its drawing capacity decreases. Finally, if the total Mg + Si is slightly higher than 1.6%, the hemming ability of the alloy becomes poor.

According to a feature of the invention, the alloy includes, apart from the normal impurities in aluminum, additional elements such as any one or more of the following metals, in the following amounts, by weight of the alloy:

up to 0.2% Cr
up to 0.4% Mn
up to 0.2% Ti
up to 0.2% Zr
less than 0.5% Fe.

It has been established that the presence of some or all of these elements allows certain of the properties of the alloys mentioned earlier to increase. For example, an amount of Cr of approximately 0.1% increases the hemming capacity and the mechanical properties in the T4 state (according to the French standard NF A 02-003); a small percentage of Mn improved the weldability under tension of the alloys of the invention.

It is important that the content of iron, which is often an impurity in aluminum, be less than 0.5% and, preferably, not above 0.2%. The presence of 0.5% or more of iron will no longer allow hemmability, which is an important feature of the present invention.

Preparation of the series of alloys according to the invention and their conversion into semi-manufactured products, such as sheet metal, and manufacture from the latter by plastic deformation and machining, according to known methods, are carried out in similar ways to those used for alloys of the $AU_2G$ type. For example, after homogenization of the alloy for 10 to 15 hours at a temperature of 500° to 550° C., hot rolling can be effected directly to produce a certain thickness and then cold rolling to obtain the final desired thickness. According to one variant, the metal part is cooled to the ambient temperature after homogenization, reheated and hot rolled, followed by cold rolling. Finally, according to another variant, the alloy is reheated directly, without previous homogenization, and then is hot rolled and finally cold rolled.

Irrespective of the method of operation as outlined above, the next treatment steps are to place the metal into the T4 state. To do this the metal is subjected to solution heat treatment, i.e. holding the alloy at a temperature and time sufficient to obtain a homogeneous solid solution. The heated metal is then quenched to room temperature and naturally aged at room temperature to a substantially stable condition. Specifically, the metal is heated to 500°–550° C for 1 to 2 minutes for the solution heat treatment and is then quenched either in cold water or in pulsated air or by pulverization of a spray of water on the sheet metal.

After natural ageing, the metal sheets so obtained can then be worked into the final products and, without losing their mechanical properties, can undergo the operations of stamping, pressing, drawing and then hemming, welding and painting which are normally practiced in the motor vehicle industry for the manufacture of bodywork.

DETAILED DESCRIPTION OF PREFERRED EMBODIMENTS

The following examples, described by way of illustration show how the invention can be put into practice and indicate, by a series of comparative measures, the surprising combination of properties of the alloys according to the invention, by comparison with several aluminum alloys in the same class, but whose alloying elements are in different proportions from those mentioned above. They show equally the interesting results due to the presence or addition of elements such as Mn and Cr.

EXAMPLE 1

An alloy according to the invention, referred to below as (A), includes, apart from aluminum, the following elements:

Cu : 1.92%
Mg : 0.67%
Si : 0.60%
Cr : 0.07%
Fe : 0.20%
Mn ≤ 0.01%

This was cast by a semi-continuous method and, then after rolling at 500° C up to a thickness of 5 mm, was cold rolled to have a thickness of 1.2 mm. After solution heat treatment by thermal treatment at 525° C for 90 seconds, the sheet was quenched in cold water.

All the characteristic properties of the sheets manufactured from this alloy (A) were then evaluated, namely, mechanical characteristics, drawing capacity, hemming ability and weldability, by comparison with those of alloys (B) to (J) of the Al-Cu-Mg-Si type prepared in the same way but having different compositions, for at least one of the essential metals, relative to the alloys of the invention.

1.01 — Mechanical Characteristics a. Firstly, development of mechanical characteristics under traction was measured as a function of the duration of ageing, immediately after quenching, while remaining at the ambient temperature.

The tests were carried out on the alloy (A) as well as on the following comparable aluminum alloys:

| | | | | | | | |
|---|---|---|---|---|---|---|---|
| (B) | Cu | : | 1.4% | (C) | Cu | : | 1.5% |
| | Mg | : | 0.69% | | Mg | : | 0.40% |
| | Si | : | 0.44% | | Si | : | 0.40% |

the proportions of the elements such as Cr, Fe and Mn for (B) and (C) being similar to those of the alloy (A).

The results obtained are listed in Table 1 below, in which:

EL(2) is the elastic limit at 0.2% in $Kg/mm^2$;
R is the tensile strength in $Kg/mm^2$;
E% is the elongation in %.

TABLE 1

| Alloy | Ageing | Rolling Direction | | | | | |
|---|---|---|---|---|---|---|---|
| | | Lengthwise | | | Transverse | | |
| | | EL(2) | R | E% | EL(2) | R | E% |
| | 1 hour | 7.4 | 23.5 | 32.0 | 7.3 | 23.0 | 35.1 |
| | 2 days | 16.8 | 32.9 | 32.1 | 16.3 | 32.3 | 31.1 |
| (A) | 15 days | 19.0 | 35.2 | 32.3 | 18.4 | 34.5 | 33.8 |
| | 1 month | 19.5 | 36.3 | 33.3 | 19.0 | 35.3 | 33.8 |
| | 2 months | 19.5 | 35.8 | 33.9 | 19.2 | 35.2 | 36.2 |
| (B) | 1 month | 16.1 | 32.0 | | | | |
| (C) | 1 month | 15.8 | 31.5 | | | | |

It can be seen from this table that:

the alloy (A) according to the invention is in practice stabilized after only 15 days of ageing;

the alloy (B), which includes less Cu than (A), and alloy (C), whose Mg content is less than that of the invention, both show insufficient mechanical characteristics which are clearly inferior to those of alloy (A), after ageing for 1 month.

b. Development of the above-mentioned mechanical properties was then studied, by carrying out, 1 month after quenching, thermal treatment at a temperature of 180° C for 1½ hours.

The steps taken on alloy (A) and on alloy (D) of the composition:

| | | | |
|---|---|---|---|
| (D) | Cu | : | 2.0% |
| | Mg | : | 0.80% |
| | Si | : | 0.25% |

have shown that the tensile strength for (A) increased from 36.3 (before treatment) to 37.9 $Kg/mm^2$, while for alloy (D), on the contrary, it decreased by more than 1 Kg/mm² from 30.9 to 29.8 Kg/mm².

This shows that an alloy such as (D), whose Si content is lower than that of alloy (A), will be unfavorably influenced during treatment for the polymerization and baking of paints, in the manufacture of motor vehicle bodies.

1.02 — Drawing Tests

Steps have been taken according to two known methods, namely Erichsen and KWI, on the one hand on alloy (A) and on the other hand on 2 alloys (E) and (F) which are of the Al-Cu-Mg-Si type, but which have amounts of certain components which are different from those according to the invention:

| | | | | | | | |
|---|---|---|---|---|---|---|---|
| (E) | Cu | : | 2.05% | (F) | Cu | : | 2.0% |
| | Mg | : | 0.73% | | Mg | : | 1.0% |
| | Si | : | 0.87% | | Si | : | 0.68% |

The results obtained are listed briefly in Table 2 below, where:

$F_m$ is the maximum limit of draw before rupture;

*d%* is the percentage of variation in diameter of the hole after the crack has appeared.

TABLE 2

| Alloy | Erichsen $F_m$ (mm) | K W I $F_m$ (mm) | K W I d % |
|---|---|---|---|
| (A) | 11.1 | 9.6 | 57 |
| (E) | 9.7 | 6.9 | 36 |
| (F) | 9 | 7.3 | 40 |

It can be concluded that the alloy (E), whose Si content is higher than 0.8%, and alloy (F), in which Mg + Si 1.6%, have less suitability for drawing than alloy (A) of the invention.

1.03 — Hemming Test

The minimum radius (rm) of bending through 180° has been measured and the ability of hemming (made by estimation) has been determined for sheets of the size 350 × 500 (mm) obtained with the following alloys, prepared under the same conditions:

alloy (A) above comparable alloys of the Al-Cu-Mg-Si type, having different component contents from those of the range mentioned according to the invention, that is to say:

| | | | | | |
|---|---|---|---|---|---|
| (G) | Cu : 2.0%<br>Mg : 1.05%<br>Si : 0.50% | (H) | Cu : 2.0%<br>Mg : 0.65%<br>Si : 0.87% | (I) | Cu : 1.50%<br>Mg : 1.0%<br>Si : 0.80% |

an alloy of the Al-Cu-Mg-Si type comparable to alloy (A) but having 0.5% iron:

| | | | | | | |
|---|---|---|---|---|---|---|
| (J) | Cu | : | 1.95% | Fe | : | 0.51% |
| | Mg | : | 0.65% | Ti | : | 0.02% |
| | Si | : | 0.50% | Cr | : | 0.07% |

The results listed on Table 3 have been obtained, where rm is expressed as *n* times the thickness of the tested sheet.

TABLE 3

| Alloy | rm | Suitability for hemming |
|---|---|---|
| (A) | 0.45 | good |
| (G) | 0.60 | poor |
| (H) | 0.80 | poor |
| (I) | 0.70 | poor |
| (J) | 0.90 | poor |

Taking into account the fact that a radius rm of more than 0.5 excludes all possibility of hemming, it can be seen that only the sheets obtained from alloys of the composition of the invention can be considered hemmable.

1.04 — Welding Test

A series of welding tests under biaxial tension, consisting of deforming of metal disc, fastened at its periphery, with the aid of a punch, and then making an arc weld line under argon and measuring the deflection corresponding to the deformation of the disc, has been carried out by the applicants on the alloys of the types (A), (B), (C) and (H) above.

It has been established, by inspection of the lengths of the cracks which appear with increasingly greater deformation that, apart from the alloy (D) with a silicon content less than 0.4%, the alloys used in the experiment were equally well suited for welding. It will be recalled, however, that, as indicated in the preceding paragraphs, the alloys (B) and (D) have the disadvantage of poor characteristic properties in the quenched and aged state (alloy B) or after thermal treatment of the type involved in painting (alloy D) and that alloy (H) is not hemmable; only the alloys of the type (A) according to the invention have, together with excellent mechanical characteristics, the double property of being hemmable and weldable at the same time.

In order to show the differences in the weldability of an alloy of the Al-Cu-Mg-Si type (in particular $AU_2GS$) and alloys of the Al-Cu-Mg type currently used for the manufacture of vehicle bodywork panels, argon arc welding tests have been carried out according to the TIG method (with a refractory electrode) on T4 sheets (solution heat treatment, quenching and natural ageing) and left for 6 months. Then the mechanical characteristics obtained were measured, in comparison with the following alloys:

| | | |
|---|---|---|
| ($A_1$), according to the invention | Cu : 2.0%<br>Mg : 0.9%<br>Si : 0.50% | Mn : 0.13%<br>Fe : 0.18%<br>Ti : <0.02%<br>Zn : 0.03% |
| (K), of the $AU_2G$ type | Cu : 2.4%<br>Mg : 0.60%<br>Si : 0.30% | Mn : <0.2%<br>Fe : 0.7%<br>Ti : 0.2%<br>Zn : 0.25% |

The results obtained are listed in Table 4.

TABLE 4

| Alloy | Nonwelded (tansverse) EL(2) | R | E% | Welded (transverse) EL(2) | R | E% |
|---|---|---|---|---|---|---|
| ($A_1$) | 21.6 | 37.2 | 26.3 | 19.2 | 34.7 | 14.3 |
| (K) | 17.8 | 31.3 | 28.6 | 14.8 | 25.4 | 17.8 |

It can be seen from this comparison that the alloys with 0.4–0.8% Si according to the invention behave much better than the other alloys used until now for the vehicle bodywork.

EXAMPLE 2

An alloy ($A_2$) according to the invention was prepared, as described at the beginning of Example 1, of the same type as the alloy (A), except that it includes 0.3% manganese (instead of 0.01% maximum).

It has been established that the mechanical properties in the T4 state of sheets made from the alloy ($A_2$) were slightly better in comparison with those of alloy (A). For instance, 2 months after quenching, the elastic limit EL(2) increased from 19.5 to 20.2 Kg/mm$^2$, the tensile strength R from 35.2 to 35.9 and the elongation E decreased from 36.2 to 32%.

It should be recalled, however, as shown by the weldability test for alloy ($A_1$), in the paragraph 1.04 of Example 1, that an alloy containing Mn according to the invention is excellently suited to welding.

EXAMPLE 3

In carrying out comparative hemming tests, as mentioned in paragraph 1.03, on sheets obtained on the one hand with the alloy (A) of Example 1 and on the other hand with an alloy ($A_3$) of the same composition, but including 0.15% chromium (instead of 0.07% for (A)), it has been noted that the hemming ability remained very good, since the bending radius rm was 0.45 in both cases.

The mechanical properties, drawability and weldability of the alloy ($A_3$) were moreover very good, being very similar to those of the alloy (A).

It will be obvious to those skilled in the art that various changes may be made without departing from the scope of the invention and the invention is not to be considered limited to what is described in the specification.

What is claimed is:

1. A method of making shaped sheet metal with improved mechanical properties using sheet metal of an aluminum alloy in the T4 state consisting essentially of 1.5 to 2.5% by weight copper, 0.5 to 1.0% by weight magnesium and 0.4 to 0.8% by weight silicon, wherein the total magnesium and silicon content is not more than 1.6%, and wherein iron is not present in 0.5% or more, with the balance of the alloy being aluminum, comprising:

drawing said sheet metal into the desired shape; and hemming the shaped metal.

2. A method in accordance with claim 1, further including the step of:

performing a welding operation on the shaped metal as is normally practiced in the motor vehicle industry for the manufacture of bodywork.

3. A method in accordance with claim 1, further including subjecting the shaped metal to a thermal treatment cycle corresponding to the baking of paint.

4. A method in accordance with claim 1, wherein said drawing and hemming steps shape the metal into a piece of bodywork for a vehicle.

5. Hemmed and drawn pieces of sheet metal, suitable for use in automobile body work, wherein the sheet metal which is hemmed and drawn is an aluminum alloy in the T4 state consisting essentially of 1.5 to 2.5% by weight copper, 0.5 to 1.0% by weight magnesium and 0.4 to 0.8% by weight silicon, wherein the total magnesium and silicon content is not more than 1.6%, and wherein iron is not present in 0.5% or more, with the balance of the alloy being aluminum.

6. Hemmed and drawn pieces in accordance with claim 5, wherein said alloy also contains, by weight, at least one of:

up to 0.2% of chromium,
up to 0.4% of manganese,
up to 0.2% of titanium, and
up to 0.2% of zirconium.

7. Hemmed and drawn pieces in accordance with claim 6, wherein said alloy comprises, by weight, about 1.92% copper, about 0.67% magnesium, about 0.60% silicon, about 0.07% chromium, about 0.20% iron and up to about 0.01% manganese, the balance being aluminum and normal impurities of other metals.

8. Hemmed and drawn pieces in accordance with claim 6, wherein said alloy comprises, by weight, about 2.0% copper, about 0.9% magnesium, about 0.50% silicon, about 0.13% manganese, about 0.18% iron, up to about 0.02% titanium and up to about 0.03% zinc, the balance being aluminum and normal impurities of other metals.

9. Hemmed and drawn pieces in accordance with claim 6, wherein said alloy comprises, by weight, about 1.92% copper, about 0.67% magnesium, about 0.60% silicon, about 0.15% chromium, about 0.20% iron and up to about 0.01% manganese, the balance being aluminum and normal impurities.

10. Vehicle body parts made from the hemmed and drawn pieces of claim 5.

11. A method of making hemmed and drawn pieces comprising:

preparing an alloy consisting essentially of 1.5 to 2.5% by weight copper, 0.5 to 1.0% by weight magnesium and 0.4 to 0.8% by weight silicon, wherein the total magnesium and silicon content is not more than 1.6%, and wherein iron is not present in 0.5% or more, with the balance of the alloy being aluminum;

rolling the alloy into a metal sheet;
subjecting the sheet to solution heat treatment;
quenching the heated sheet;
naturally ageing the quenched sheet;
drawing the sheet into the desired shape; and
hemming the shaped metal.

12. A method in accordance with claim 11, further including the step of subjecting the hemmed and drawn sheet to a thermal treatment cycle corresponding to the baking of paint.

* * * * *